US006112813A

United States Patent [19]

Head

[11] Patent Number: 6,112,813

[45] Date of Patent: Sep. 5, 2000

[54] METHOD OF PROVIDING A CONDUIT AND CONTINUOUS COILED TUBING SYSTEM

[76] Inventor: Philip Head, 78 Brent Crescent, London NW10 7XR, United Kingdom

[21] Appl. No.: 09/018,527

[22] Filed: Feb. 4, 1998

[30] Foreign Application Priority Data

Feb. 20, 1997 [GB] United Kingdom ..... 9703551
Jun. 5, 1997 [GB] United Kingdom ..... 9711594

[51] Int. Cl.[7] ..... E21B 19/22; E21B 36/00

[52] U.S. Cl. ..... 166/302; 166/57; 166/65.1; 166/77.2; 166/241.6; 166/242.2; 166/384

[58] Field of Search ..... 166/57, 65.1, 77.2, 166/241.6, 242.2, 285, 292, 294, 295, 302, 384, 385; 174/47, 100

[56] References Cited

U.S. PATENT DOCUMENTS 4,523,644 6/1985 Dismukes ..... 166/302
4,569,392 2/1986 Peterman ..... 166/65.1
5,146,982 9/1992 Dinkins ..... 166/65.1
5,236,036 8/1993 Ungemach et al. ..... 166/77.2
5,269,377 12/1993 Martin ..... 166/385
5,348,097 9/1994 Giannesini et al. ..... 166/385
5,638,904 6/1997 Misselbrook et al. ..... 166/384
5,769,160 6/1998 Owens ..... 166/65.1
5,785,125 7/1998 Royer ..... 166/241.6 X
5,920,032 7/1999 Aeschbacher et al. ..... 174/47

FOREIGN PATENT DOCUMENTS 0 505 815 A3 3/1992 European Pat. Off. .

*Primary Examiner*—George Suchfield
*Attorney, Agent, or Firm*—Herbert Dubno

[57] ABSTRACT

Coiled tubing for weld purposes is provided with a conduit which can be connected to a power source at one end and to a power device intended to be lowered into the well at the other. The tubing is filled with a low viscosity composition which is then set to a high viscosity state to anchor the conduit to the inner wall of the tubing and thereby hold the conduit in place so that the coiled tubing will not suffer from the capstan effect.

12 Claims, 11 Drawing Sheets

METHOD OF PROVIDING A CONDUIT AND CONTINUOUS COILED TUBING SYSTEM

FIELD OF THE INVENTION

This invention relates to a method of providing a conduit and continuous coiled tubing system and apparatus therefore, in particular for operating and deploying a powered device in an oil or gas well.

BACKGROUND OF THE INVENTION

Coiled or continuous reel tubing has been used in the oil industry for the last 20–30 years. The fact that it is a continuous single tube provides several advantages when entering a live oil or gas well which could have anything up to 7,000 psi well head pressure. This means the well does not have to be killed, (i.e. a heavy fluid does not have to be pumped down the production tubing to control the oil or gas producing zone by the effect of its greater hydrostatic pressure). Continuous tubing has the advantage of also being able to pass through the tubing through which the oil and/or gas is being produced without disturbing the tubing in place.

Since its introduction, the uses and applications for coiled tubing have grown immensely, and now, rather than just being used to circulate various fluids in a well bore, it is not uncommon for coiled tubing to be used for conveying various hydraulically powered tools and more recently electrically powered tools on its end into the well. This has resulted in conventional electrical wire-line logging cables or small hydraulic conduits being inserted into the inside of the reel of tubing so that these more sophisticated tools can be used and services can be performed.

A disadvantage which has resulted from this practice is the capstan effect of the smaller diameter wire-line or hydraulic tube tending to be pulled very tightly to the inner surface of the continuous reel of tubing. When considering the effect this has on the geometry, it will be appreciated that the wire-line or small hydraulic conductor will have a slightly smaller pitch circle diameter than the larger reeled tubing. The consequence of this is that for each complete 360 degrees the wire-line or hydraulic tube will be slightly shorter in length than the larger reeled tubing, so if this is added up over its total length of 12,000 ft (3657 m) or usually longer, the difference in lengths could be as much as 200 ft (61 m).

This problem has been recognised due to the operational problems encountered. Either one end of the wire-line or hydraulic tube has been pulled out of its connection, or else the reeled tubing itself begins to form a low frequency wave form caused by the tension in the conduit inside the reeled tubing, which prevents the reeled tubing being lowered any deeper into the well without the risk of damaging it.

Another disadvantage with using traditional wire line inside reeled tubing is that it is not compatible with many of the fluids pumped through the reeled tubing, the more common ones being corrosive stimulation fluids, and cement slurries used generally for zonal isolation. The reason for this is that the wire line has two outer reinforcing layers of braided wire followed by an insulation layer protecting the conductors, which typically number up to eight. The normal insulation material is not compatible with the acid systems, although some expensive materials are available, but the total price becomes prohibitively expensive. Alternatively, when pumping cement slurries, the gaps between the braided wire of the cable form natural traps which collect some deposits of the cement slurry, which, when set, either make it difficult for the wire-line to bend. More commonly, the particles of set cement break off leaving residue inside the reel.

Consequently and additionally this has the effect of increasing the weight of the conduit and for conduits having a certain length the conduit is prone to stretching or creep when installed in the well and in particular when it is intended to remain in position for a relatively long period of time for production of the well. The type of conduit for which stretching is a problem depends upon the weight per unit length of the conduit, the material of the conduit and the expected working life of the conduit as well as the nature of the immediate environment surrounding the conduit, although in many applications the invention enables the conduit to be installed in coiled tubing with a dielectric oil between them. Nevertheless stretching of the conduit is frequently a serious problem.

OBJECT OF THE INVENTION

It is an object of the present invention to provide a conduit, coiled tubing system which avoids this problem of stretching and overcomes the other disadvantages of present known systems mentioned above.

SUMMARY OF THE INVENTION

According to the invention there is provided method of providing a conduit within a coiled tubing system for deployment in a well, in which the coiled tubing comprises a wall and an internal bore, wherein the conduit is connected at one end to a power supply at the surface, and wherein the space between the conduit and the inside wall of the coiled tubing is filled with a filling material in a relatively low viscosity fluid state, and wherein the filling material subsequently sets to a higher viscosity, more solid state, in which state the filling material serves to transfer the weight of the conduit to the wall of the coiled tubing thereby supporting the conduit.

According to the invention the space between the conduit and the inside wall of the coiled tubing is filled with the filling material. Preferably the filling material is a material which occurs in a low viscosity fluid state, in which state it is pumped into the space between the conduit and the coiled tubing, and a higher viscosity, more solid state, in which state the filling material serves to transfer the weight of the conduit to the wall of the coiled tubing thereby supporting the conduit.

The filling material may be provided in the form of a slurry which sets after a period of time to form a rubber-like solid with a relatively high viscosity such as of the order of 10,000 poise. The filling material preferably sets by means of a curing process. The curing process may be initiated by temperature.

The filling material may be based on a two part liquid silicone product which cures at approximately room temperature or an ambient temperature which can be preselected for the chosen application.

The filling material may also be a suitable compound which cures at a selected temperature.

The filling material may be pumped into the conduit while the coiled tubing is arranged in the coiled state on a reel. The conduit may be installed in the coiled tubing on the reel or alternatively pulled into the coiled tubing while it is is laid out horizontally. The conduit may be supported in a central position within the coiled tubing by centering elements or spacers before the filling material is pumped in to ensure that the filling material surrounds the conduit providing an even support therefor.

The filling material may also be pumped in while the coiled tubing and conduit are laid out horizontally. Alternatively spacers are not used and the conduit is allowed to rest on the lower wall of the tube and the filling material fills the area above it. Preferably the coiled tubing is then rotated through 90 degrees before rolling on to the drum reel so that the cable inside is arranged on the center line of the coiled tubing.

The conversion of filling material from the low viscous state to the higher viscous state may occur by a curing process which may be initiated by heating the coiled tubing.

The conduit may be pre-installed inside the coiled tubing and attached to the powered tool at the surface and the system lowered down the well together to the desired location. Alternatively the conduit and the powered device may be lowered to the desired location first and then subsequently the conduit is lowered and connected to the powered device by means of a remote interlocking mechanism.

BRIEF DESCRIPTION OF THE DRAWING

The following is a more detailed description of some embodiments of the invention by way of example, reference being made to the accompanying drawing, in which.

SPECIFIC DESCRIPTION

Figure 1:
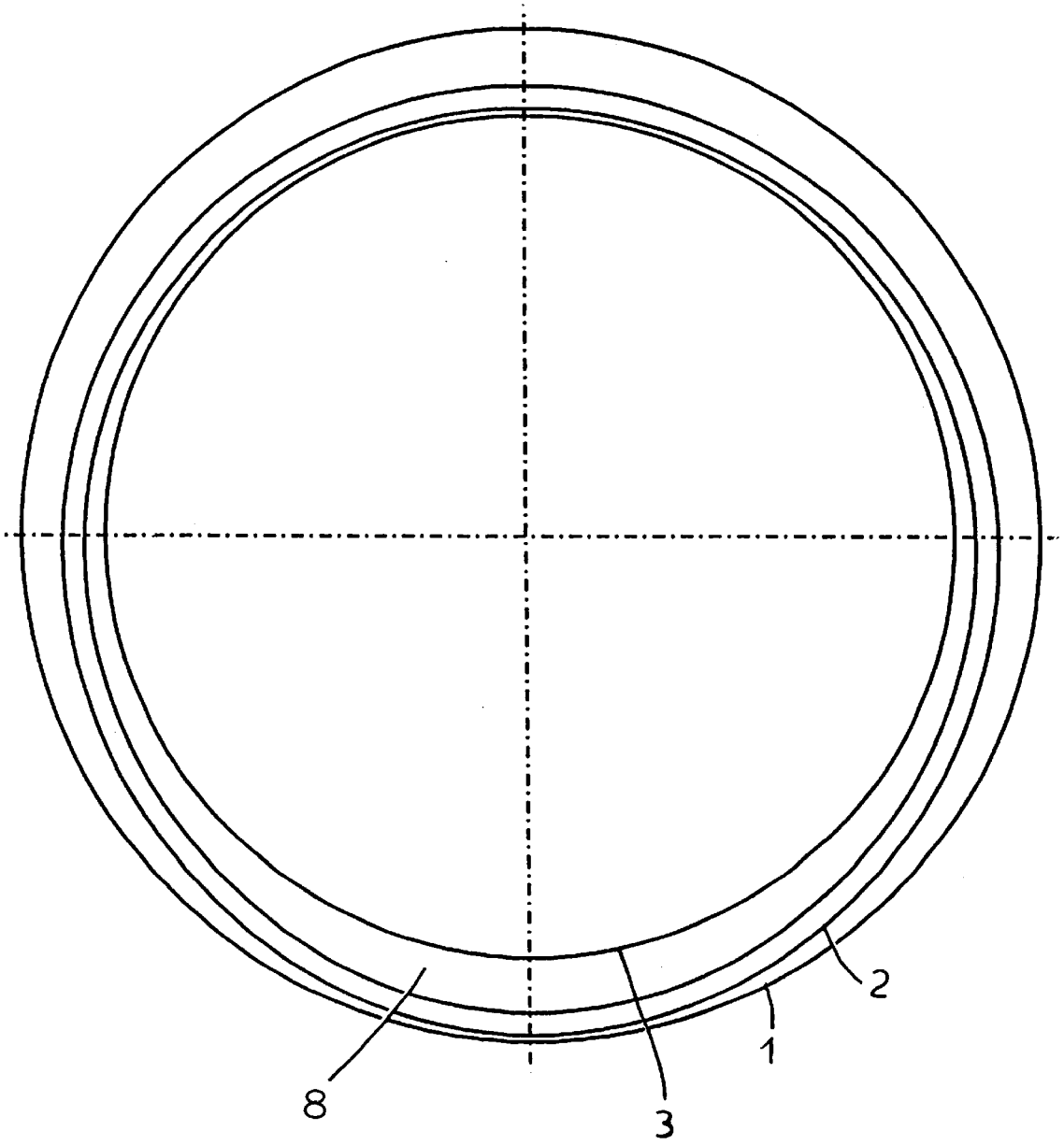
FIG. 1 shows a side view of a coiled tubing reel showing a pre-installed conduit.

Referring first to FIG. 1, there is shown a side cross-sectional view of one wrap of coiled tubing 1, with a conduit 2, lying on the inside wall 3 of the coiled tubing. It will be appreciated that because the coiled tubing and the conduits have different center line diameters, their lengths per wrap or turn will be slightly different with the coiled tubing being slightly longer. Multiplying this difference in length by the total number of turns enables the difference in overall length to be determined, which can be in excess of 100 ft (30 m). In first embodiment the conduit is therefore arranged to comprise a wavy profile to accommodate this. The conduit will also tend to sag on the reel due to gravity resulting in a gap 8 between the inside wall 3 and the conduit in the lower section of the reel.

The method of the invention includes providing this conduit inside the coiled tubing system for deployment in a well, in which the coiled tubing comprises a wall and an internal bore, wherein the conduit is connected at one end to a power supply at the surface, and wherein the space between the conduit and the inside wall of the coiled tubing is filled with a filling material in a low viscosity fluid state, and wherein the filling material subsequently sets to a higher viscosity, more solid state, in which state the filling material serves to transfer the weight of the conduit to the wall of the coiled tubing thereby supporting the conduit.

In the embodiment of FIG. 1 the filling material is pumped in while the coiled tubing is arranged on the reel which is convenient from the point of view of the small area required compared to laying the coiled tubing flat. From FIG. 1 it can be seen that the conduit 2 is in contact with the internal wall 3 of the coiled tubing 1 at the top section of the reel whereas the conduit is separate from the internal wall 3 of the coiled tubing 1 at the lower section of the reel leaving a gap. Thus when the filling material is pumped into the coiled tubing 1 it will be able to completely surround the conduit for part of each wrap and only partially surrounding the conduit for other part of the wrap. This provides sufficient support for the conduit for most applications.

Figure 2:
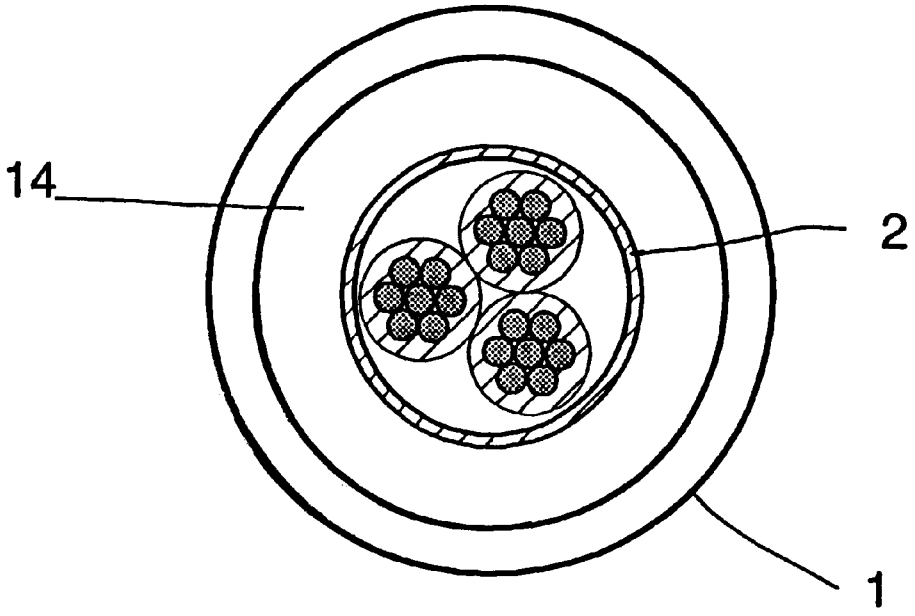
FIG. 2 shows a cross section of the conduit and coiled tubing system of the invention before applying the filler material.
Figure 3:
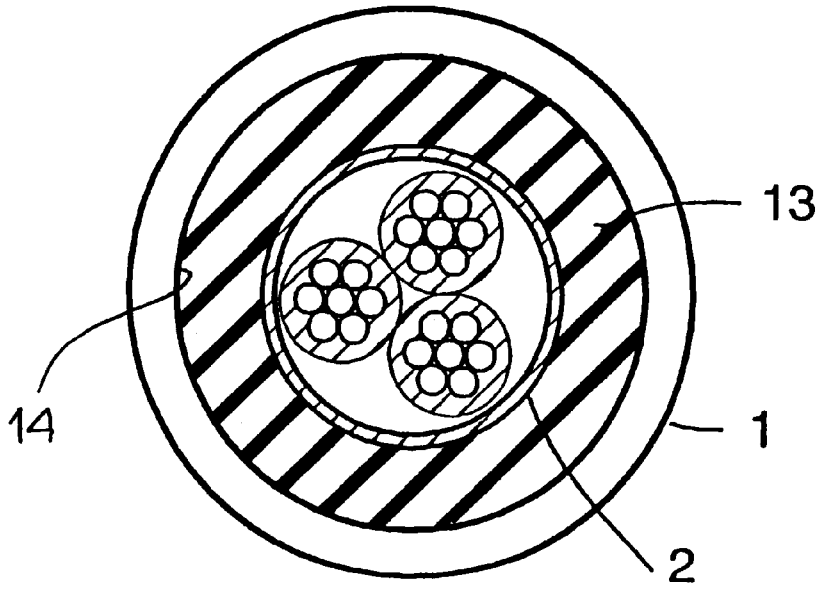
FIG. 3 shows a cross section of the system of FIG. 2 after the introduction of the filling material.

Referring to FIGS. 2 and 3 the conduit and coiled tubing system according to the invention comprise a filling material 13 in the form of a cellular foam-like material which provides an adhesive grip on the internal wall of the coiled tubing which aids the support of the conduit to the coiled tubing. In this embodiment the conduits are shown arranged centrally in the coiled tubing which can be ensured by using centering members which will be described in greater detail later. The foam like material is of the expandable form which is pumped into the coiled tubing between the conduit and the internal wall of the coiled tubing, in the unexpanded state. The foam-like expandable material is activated to expand and fill the concentric space 14 between the conduit 2 and the coiled tubing 1. The foam-like expandable material may be any suitable material which can be activated to expand. Such materials are likely to be polymeric and activated by the application of a reagent which causes the expansion process and the reagent is pumped through the coiled tubing after the conduit has been installed. Alternatively the expandable material may be activated by temperature or by time in contact with air. When in the expanded state the expandable material acts as the filler material and exerts a supporting force on conduit transmitting the weight of the conduit to the coiled tubing and thus supporting the conduit when in the vertical position in a well.

Thus it is the main feature of the invention that the space between the conduit and the inside wall of the coiled tubing is filled with a filling material 13 and that this filling material 13 acts to support the weight of the conduit in the coiled tubing. In the embodiments of FIGS. 7 to 12 the filling material 13 is a material which occurs in a low viscosity fluid state, in which state it is pumped into the space 14 between the conduit and the coiled tubing, and a higher viscosity, more solid state, in which state the filling material 13 serves to transfer the weight of the conduit 2 to the wall of the coiled tubing 1 thereby supporting the conduit 2.

In one embodiment the filling material 13 is provided in the form of a slurry which is pumped into the coiled tubing and sets after a period of time to form a rubber-like solid with a viscosity of 10,000 poise. The filling material preferably sets by means of a curing process. The curing process may be initiated by temperature.

In a further embodiment the filling material is based on a two part liquid silicon product which cures at approximately room temperature or an ambient temperature which can be pre-selected for the chosen application.

In a further embodiment the filling material is a suitably compounded polyurethane which cures at a selected temperature.

The filling material is chosen to cure after a predetermined time and this time will at least be the time taken to pump the filling material into the tubing preferably with an additional amount of time to allow for unforeseen delays.

Figure 4:
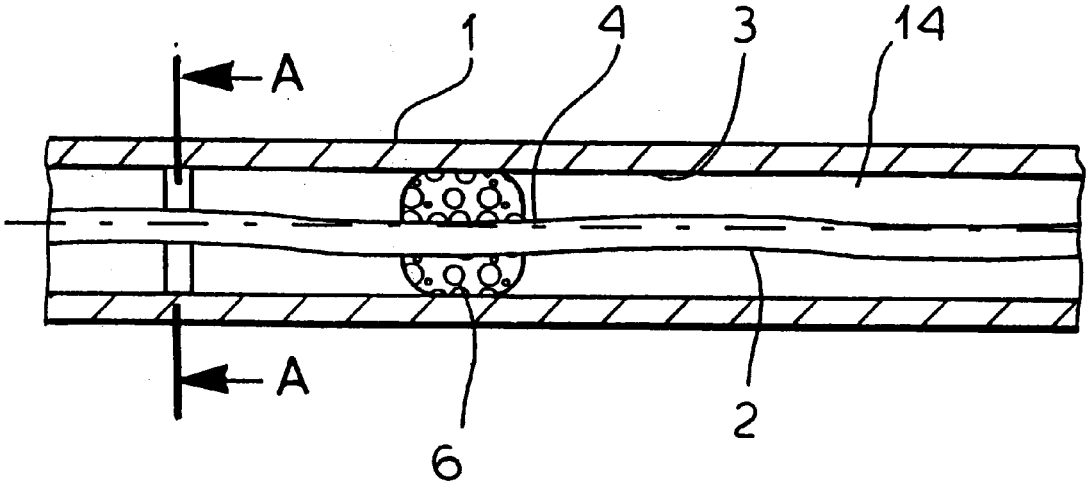
FIG. 4 shows a longitudinal cross section of the conduit and coiled tubing system of the invention showing a first embodiment of a centering means.

Referring now to FIG. 4 shows a coiled tubing system of the invention in which a centraliser 6 is provided on the external wall 4 of the conduit 2 and which acts against the internal wall 3 of the coiled tubing 1 to retain the conduit in an essentially central position inside the coiled tubing.

Figure 5:
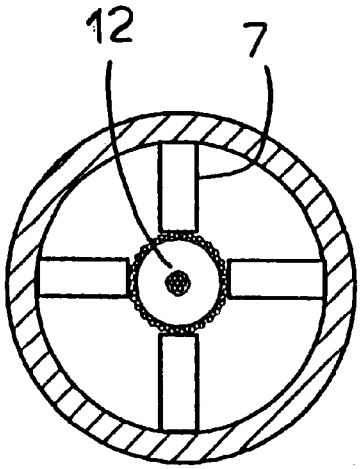
FIG. 5 shows a cross-section taken along the line A—A of FIG. 4, before adding the filler material of an alternative centering means.
Figure 6:
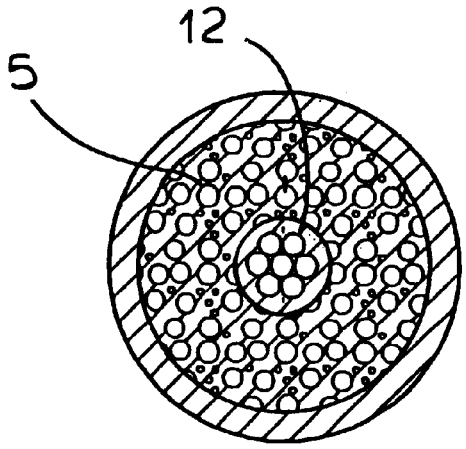
FIG. 6 shows a cross-section through a conduit before adding the filler material.

This is a temporary measure to ensure that the filler material is able to flow completely around the conduit and that when the filling material sets the conduit is maintained in an essentially central position inside the coiled tubing. The centraliser 6 shown in FIG. 4 and FIG. 6 is in the form of a porous foam type structure which is rigid enough to centralize the conduit but which also allows the filling material to flow through it so that the filling material can penetrate the whole length of the coiled tubing. FIG. 5 shows an alternative centralizing device 7 which is in the form of radially extending arms between the conduit and the coiled tubing which allow the flow of the filling material when in the fluid state between them.

Thus with the conduit maintained in the centralize position it can be ensured that the filling material will completely surround the conduit which ensures that the support for the conduit is maximized which will be important for certain applications in particular for very long conduit and coiled tubing lengths required for long or deep wells.

Figure 7:
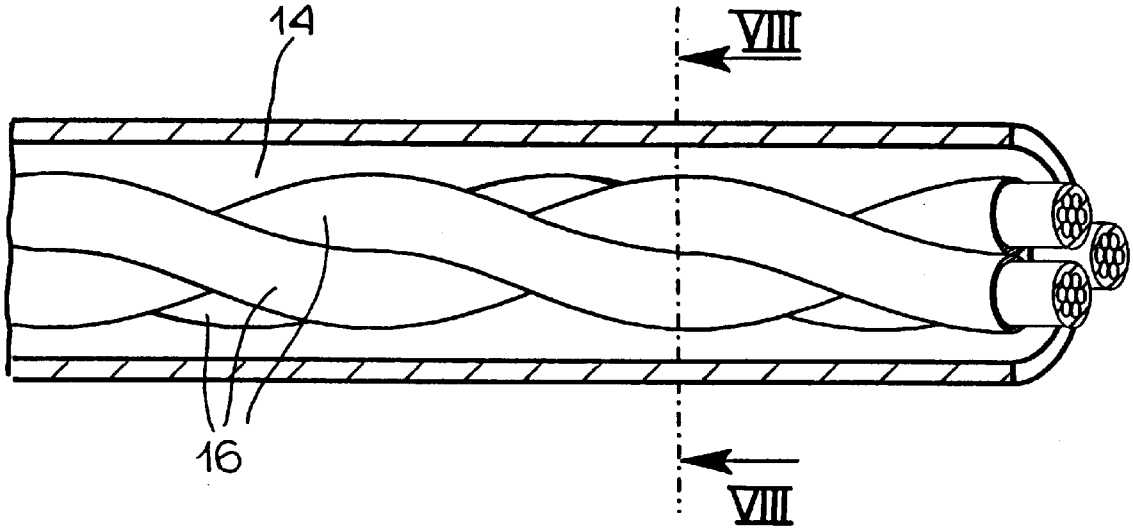
FIG. 7 shows a longitudinal cross section of the coiled tubing system including a multiple cable conduit.
Figure 8:
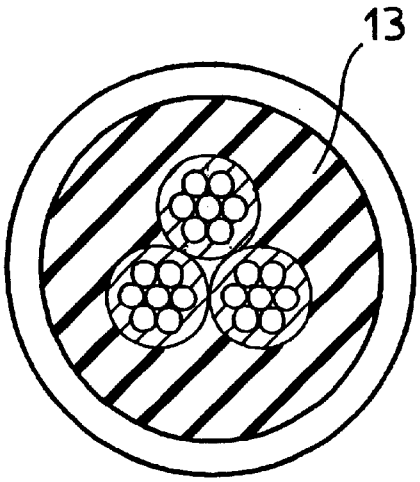
FIG. 8 shows a cross section of FIG. 7, along line VIII—VIII, after addition of the filler material.
Figure 9:
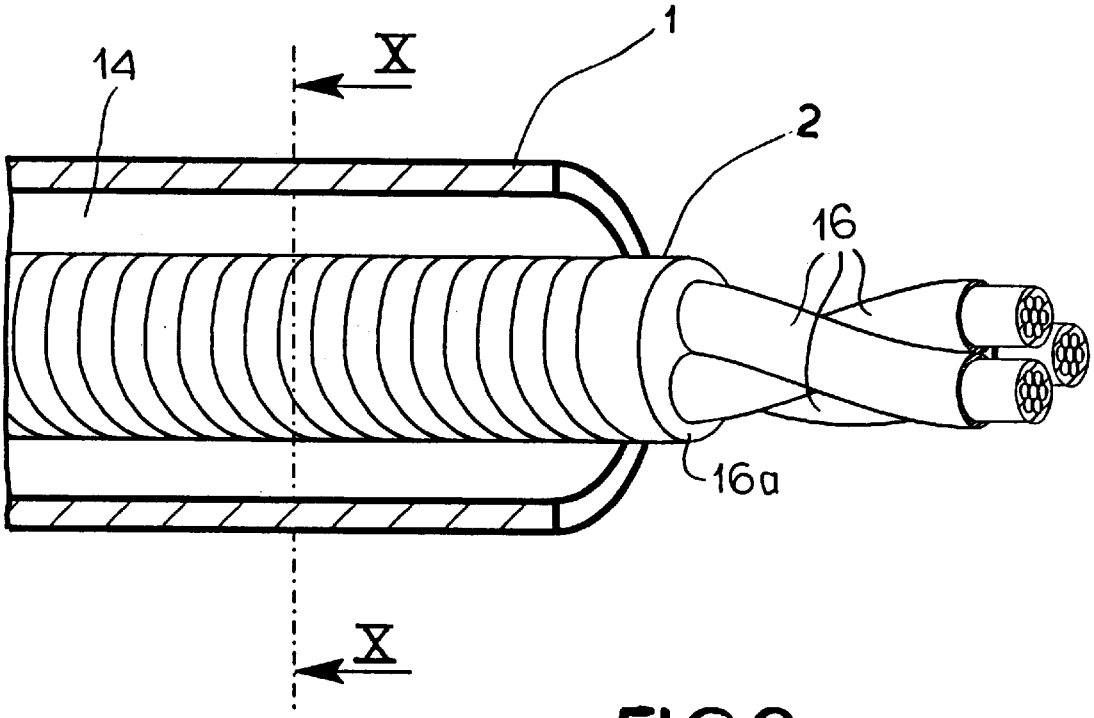
FIG. 9 shows a longitudinal cross section of the coiled tubing system including a shielded cable conduit.
Figure 10:
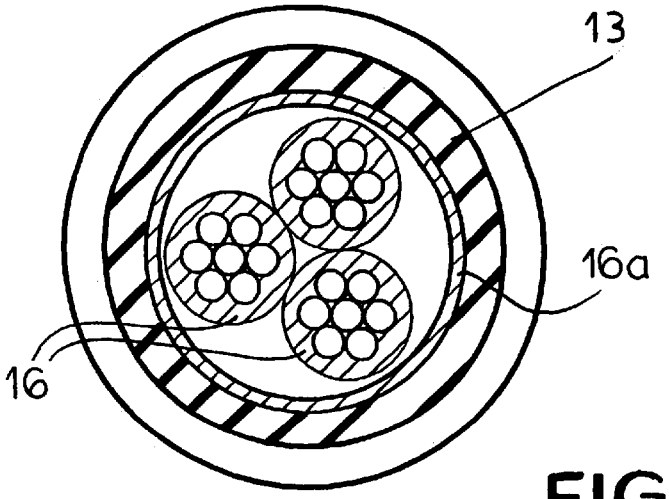
FIG. 10 shows a cross section along line X—X of the embodiment of FIG. 9 after addition of the filler material.
Figure 11:
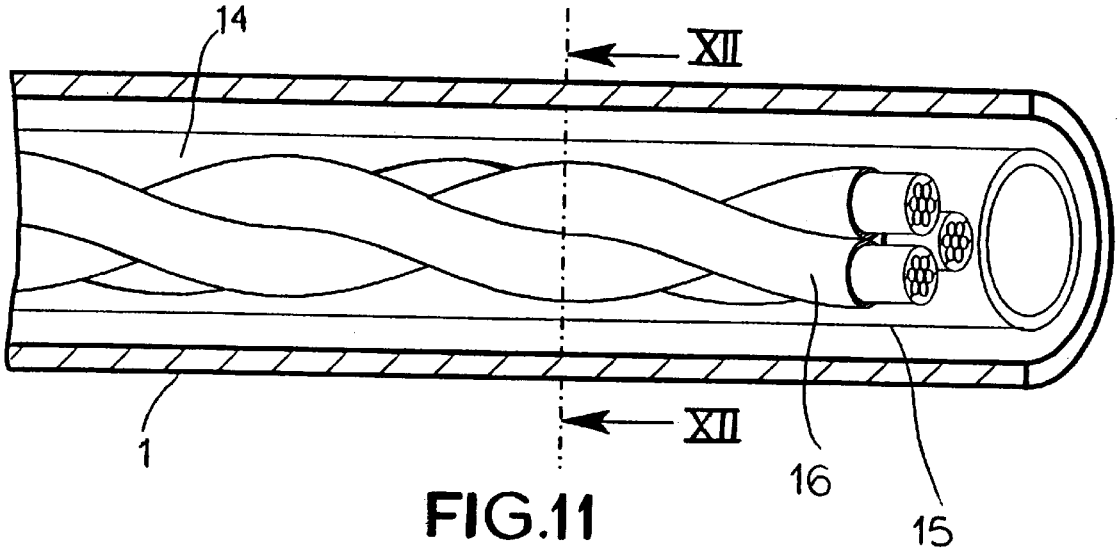
FIG. 11 shows a longitudinal cross section of the coiled tubing system of the invention including an additional tubular conduit.
Figure 12:
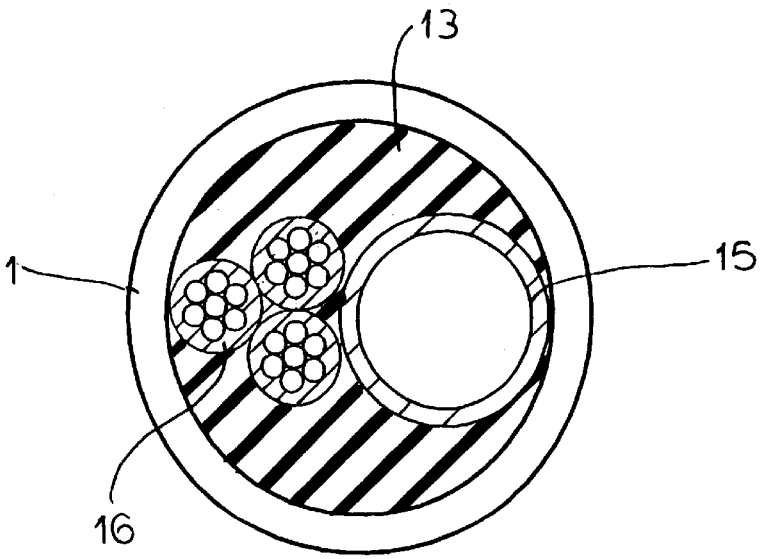
FIG. 12 shows a cross section along line VII—VII of the embodiment of FIG. 11 after the addition of the filler material.

The conduit may be in a variety of forms; in FIG. 4 the conduit 2 is shown as a plain cable 2. In FIG. 5 the conduit is shown as a coaxial fiber optic cable 12. In FIG. 6 the conduit is shown as a multiple cluster of power and signal cables in a protective casing. FIGS. 7 and 8 show the conduit in the form of three separate cables 16 helically wound. FIGS. 9 and 10 show the conduit in the form of three separate cables 16 helically wound and in a protective sheath 16A. FIGS. 11 and 12 show the conduit as a helically wound triple cable 16 with an hydraulic line 15 alongside. In FIGS. 7 to 12 the longitudinal sections are shown without filling material and the transverse cross sections are shown with the space 14 filled with the filling material 13.

According to a first alternative the filling material is pumped into the conduit whilst the coiled tubing is arranged in the coiled state on a reel. The conduit may be installed in the coiled tubing on the reel or alternatively pulled into the coiled tubing while the latter is laid out horizontally.

According to a second alternative the filling material is pumped in while the coiled tubing and conduit are laid out horizontally. Spacers may not be used and the conduit is allowed to rest on the lower wall of the tube and the filling material fills the area above it as shown in FIG. 15.

Figure 13:
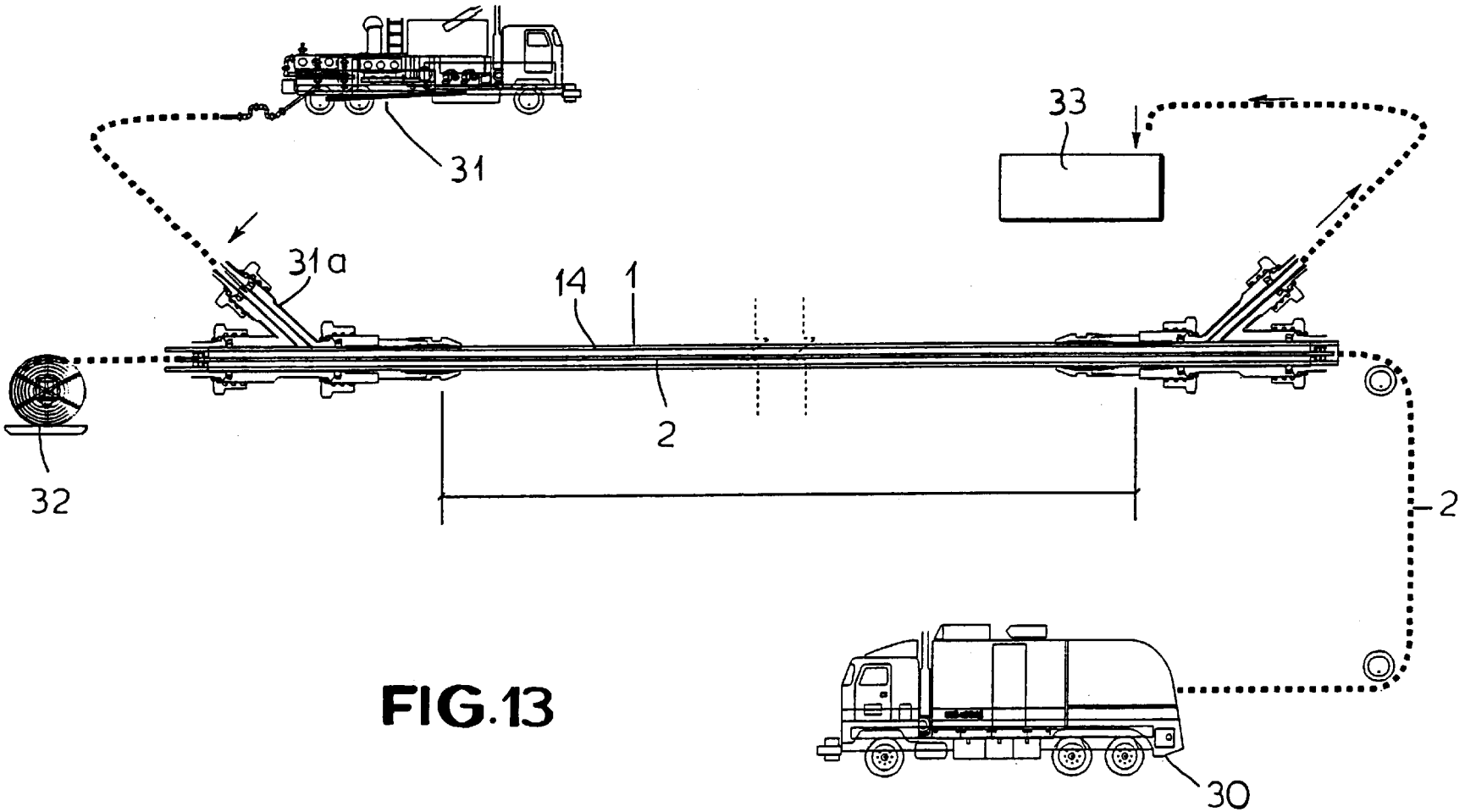
FIG. 13 shows a longitudinal cross section of the general arrangement of the method of filling the coiled tubing with the filling material in the laid out position.

In FIG. 13 the schematic representation of a method of providing the coiled tubing system of the present invention is shown. The conduit 2 arranged on a wire-line reel 32 is pulled through the coiled tubing 1 by a wire pulling unit 30. In this embodiment the coiled tubing 1 is laid out flat on a large flat surface such as a disused air field. From a tank truck 31, the filling material is introduced at 31*a*.

Figure 14:
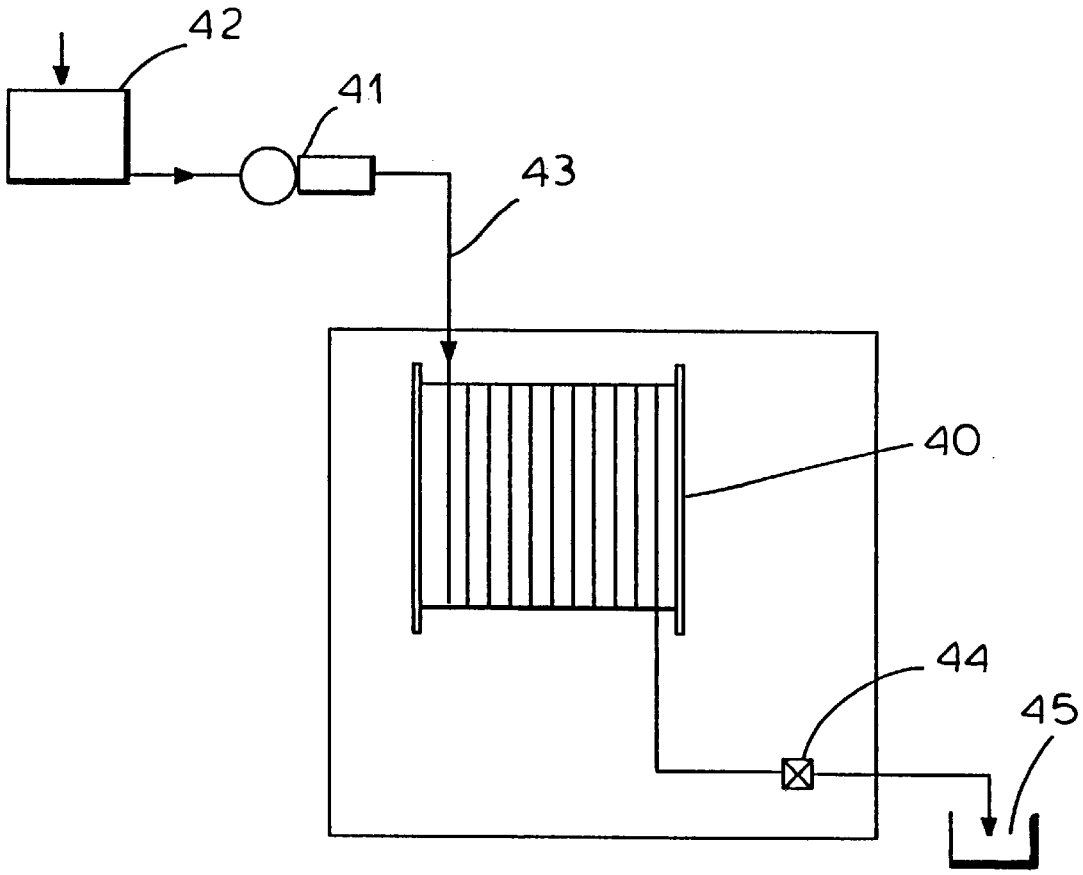
FIG. 14 shows a cross section of a second stage of the general arrangement a method of filling the coiled tubing with the filling material in the reeled position.

Referring now to FIG. 14 shows the coiled tubing is arranged on a reel 40 with the conduit either installed by pumping through while on a reel, or installed prior to reeling of the coiled tubing. The filling material is provided in a header tank 42 which feeds into a pump 41 which pumps the filling material into the coiled tubing through a pressure seal 43. When the filling material has been pumped through the enter length of the coiled tubing the pumping is continued to ensure that the filling material completely fills the gap between the conduit and the internal wall of the coiled tubing before a valve 44 arranged at the exit end of the coiled tubing is closed and the pumping is stopped. The excess filling material is collected in a surplus tank 45. The entire reel is enclosed in a controlled atmosphere room to prevent degeneration or setting of the filling material before the filling operation is complete. The filling can may occur in the presence of air and also where the temperature is controlled to prevent premature setting or curing of the filling material. Additional cooling means may be provided such as by external spraying of coolant on the external surfaces of the coiled tubing.

Figure 15:
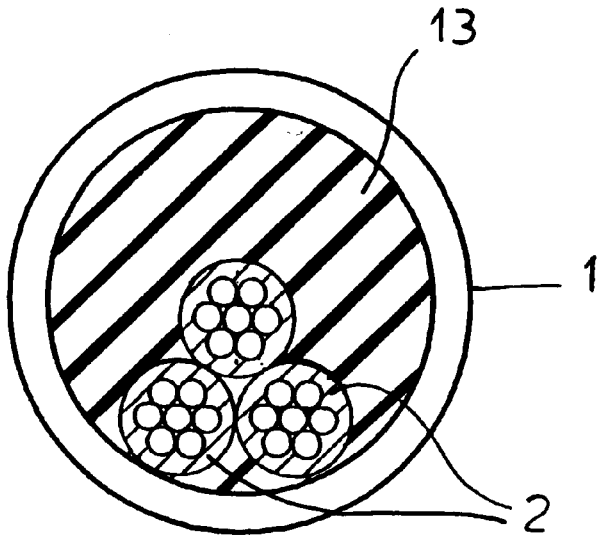
FIG. 15 shows a cross section of a coiled tubing with the filling material pumped with the coiled tube in the horizontal position and the conduit unsupported.
Figure 16:
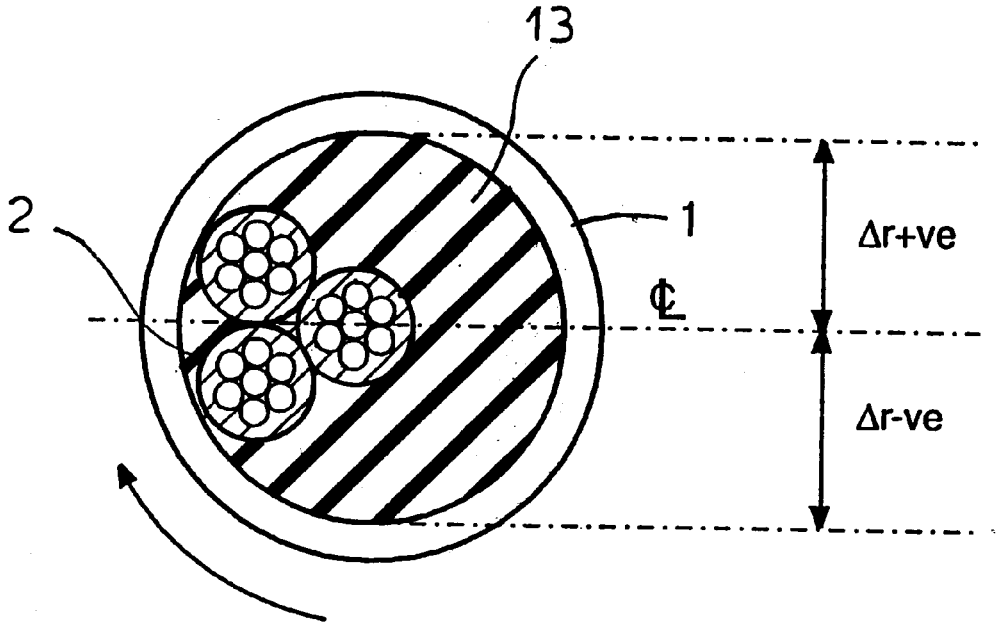
FIG. 16 shows a the cross section of FIG. 15 rotated by 90 degrees.

FIG. 15 shows a cross section of a filled coiled tubing is shown with the conduit arranged on the lower inside wall of the coiled tubing which would be the case along the whole length of the coiled tubing for the coiled tubing in the horizontal flat position. During filling as shown in FIG. 13 the spacers are not used. When the filling material has set the coiled tubing is rolled onto a drum to form a reel so that it can be transported to the well. Referring now to FIG. 16, the coiled tubing is rotated by 90 degrees before rolling it onto the drum to form the reel. This ensures that the center line of the conduits are approximately arranged on the center line of the coiled tubing and thus the differential effects of the different circumferences of each turn between the conduit and the coiled tubing resulting in changes to the required length of the conduit will be minimized.

The consequence of this is that the corresponding stresses between the filling material and the conduit resulting in potential rupture of the contacting surface between them is minimized and the gripping and supporting effect of the filling material on the conduit is not adversely effected.

Referring again to FIG. 13 the filling material 13 is pumped into the space 14 between the conduit and the internal wall of the coiled tubing by means of a pumping unit 31. When the filling material reaches the end of the length of coiled tubing the operation is complete and the ends are closed, any excess material is collected in a retrieval sump 33. The filling material then sets into the viscous state and holds the conduit in position with respect to the coiled tubing and supports the weight of the conduit when the coiled tubing is deployed in the vertical. It is essential to prevent setting of the filling material before the filling operation is complete otherwise the frictional pressure between the filling material and the coiled tubing will be so great that it will be impossible to pump the required additional filling material to complete the process.

Figure 17:
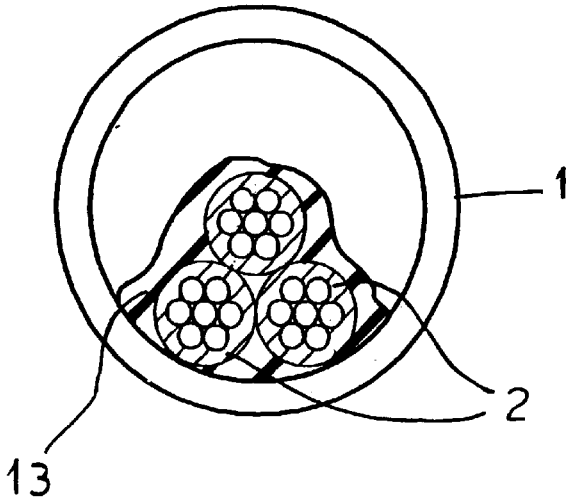
FIG. 17 shows a further embodiment of the invention with the filling material partially filling the tube and covering the conduits.

In a further preferred embodiment of the invention as shown FIG. 17, the filler material surrounds the conduits but dies not fill the internal space 14 of the tube. In this embodiment the conduit 2 is in the form of a bundle of three conduits 2 which are installed in a length of coiled tubing 1 which is laid out flat and the filling material 5 is pumped along the tube 1. The filling material will settle in the lower part of the tube 1 surrounding the conduits 2 to a sufficient extent to secure the conduits 2 to the internal wall of the tubing 1 when the filling material is cured. The tube can be rotated through 90 degrees ready for coiling onto a reel so that the conduits 2 share the same or approximately the same mean diameter as the tube 3 and fracture of the bond between the conduits 2 and the tubing 1 caused by them having different diameters during coiling is avoided.

Figure 18:
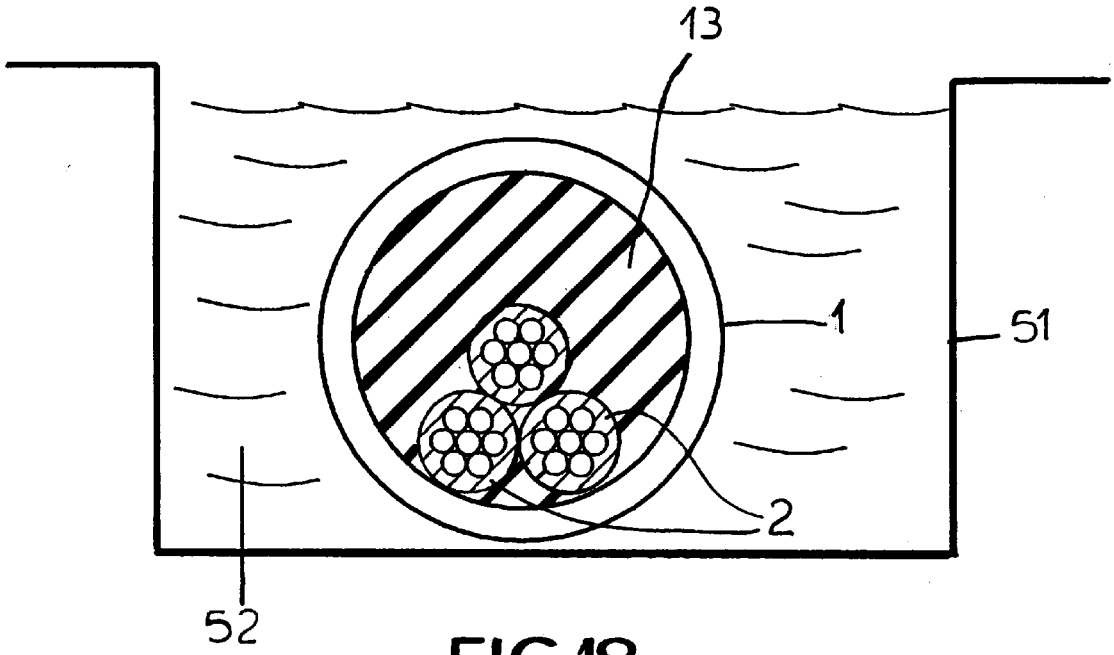
FIG. 18 shows a cross section of the coiled tubing of the invention arranged in a bath of coolant.

In FIG. 18 a cross section of a channel 51 is shown containing a coolant 52 which may be water which acts to cool the coiled tubing 1 during the filling process. This is particularly important for smaller sections and for longer lengths of tubing where the pressures required to pump the filling material into the tubing are greater and result in temperature increases due to the friction between the filling material and the wall of the tubing. Thus the cooling operation prevents premature curing of the filling material.

Figure 19:
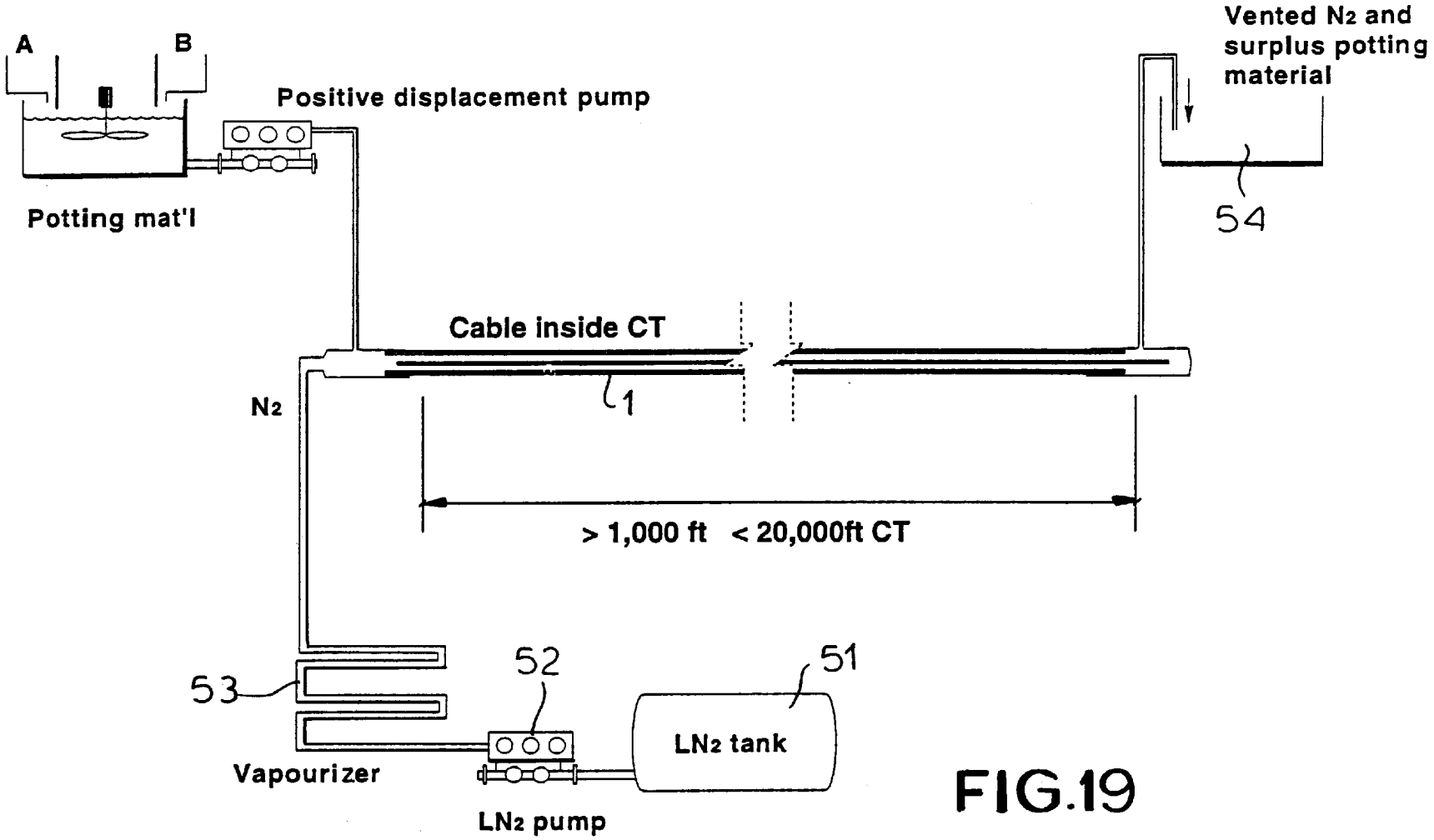
FIG. 19 shows a cross section of the schematic layout of a further embodiment of the method of the invention.

In FIG. 19 a further embodiment is shown of the method of the invention in which the filling material is pumped into the tubing 2 as explained above. Nitrogen under is pressure is also applied to the tube at the same end that the filling material is being pumped in which helps to speed up the filling process. The nitrogen is provided from a liquid nitrogen supply tank 51 and pumped via a pump 52 though a vaporiser 53 into the coilable tuning 1. The vented nitrogen exiting the opposite end of the coilable tubing 1 is collected in a tank 54 together with any surplus filling material which has been carried completely through the coilable tubing by the flow of the nitrogen gas. This is particularly useful in cases where the tube is very long or thin or where the curing properties of the filling material combined with the local environment means that the curing time is short. For example if the curing is dependent on temperature and the ambient temperature at the location is sufficient to induce curing of the filling material.

In a further alternative embodiment the filling material may also be pumped into the space while the coiled tubing is held in the vertical position for example with the coiled tubing already in a well.

What is claimed is:

1. A method of making a coiled-tubing assembly comprising the steps of:

(a) forming a coilable length of tubing for use in a well;

(b) installing a conduit in said tubing whereby said conduit is connectable at one end to a power supply and at an opposite end to a powered device, said conduit defining with an inner wall of said tubing a space extending over said length;

(c) thereafter filling said space with a filling material having a low viscosity fluid state and a high viscosity state into which said filling material can set in said low viscosity fluid state of said filling material; and (d) causing said filling material to set into said high viscosity state, thereby transferring weight of the conduit to said inner wall of said tubing and providing support for the conduit, said tubing being in a coiled state while said space is filled with said tubing material and the filling material being pumped into the tubing while it is coiled on a reel.

2. The method defined in claim 1, further comprising the step of orienting the tubing horizontally during the filling of said space with said filling material.

3. A method of making a coiled-tubing assembly comprising the steps of:

(a) forming a coilable length of tubing for use in a well;

(b) installing a conduit in said tubing whereby said conduit is connectable at one end to a power supply and at an opposite end to a powered device, said conduit defining with an inner wall of said tubing a space extending over said length;

(c) thereafter filling said space with a filling material having a low viscosity fluid state and a high viscosity state into which said filling material can set in said low viscosity fluid state of said filling material; and (d) causing said filling material to set into said high viscosity state, thereby transferring weight of the conduit to said inner wall of said tubing and providing support for the conduit; and cooling said tubing while said space is filled with said filling material.

4. The method defined in claim 3 wherein said tubing is cooled by disposing said tubing in a channel and filling said channel with a coolant.

5. The method defined in claim 3 wherein said tubing is cooled by spraying a coolant on an external surface of said tubing.

6. The method defined in claim 1 wherein, following filling of said space with said material, the tubing is rotated by 90° to orient said conduit generally along a center line of said tubing, said method further comprising the step of thereafter reeling said tubing on a drum.

7. The method defined in claim 1, further comprising the step of supporting said conduit generally centrally within said tubing by at least one spacing, prior to filling said space with said filling material, said filling material maintaining said conduit generally centrally in said tubing.

8. The method defined in claim 1 wherein said filling material is set in step (d) by curing said material.

9. The method defined in claim 1 wherein said material, in low viscosity fluid state is a slurry capable of setting into a rubber-like solid and said material in said high viscosity state is solid.

10. The method defined in claim 1 wherein said filling material is a two-part liquid silicone product.

11. The method defined in claim 1 wherein said filling material is a polyurethane.

12. A method of making a coiled-tubing assembly comprising the steps of:

(a) forming a coilable length of tubing for use in a well;

(b) installing a conduit in said tubing whereby said conduit is connectable at one end to a power supply and at an opposite end to a powered device, said conduit defining with an inner wall of said tubing a space extending over said length;

(c) thereafter filling said space with a filling material having a low viscosity fluid state and a high viscosity state into which said filling material can set in said low viscosity fluid state of said filling material; and (d) causing said filling material to set into said high viscosity state, thereby transferring weight of the conduit to said inner wall of said tubing and providing support for the conduit; and (e) pumping nitrogen with said material into the space for the filling of said space.

* * * * *